US005379537A

United States Patent [19]

Roy

[11] Patent Number: 5,379,537

[45] Date of Patent: Jan. 10, 1995

[54] TURN BUTTON

[75] Inventor: Armand E. Roy, Attleboro, Mass.

[73] Assignee: Craft, Inc., Attleboro, Mass.

[21] Appl. No.: 53,475

[22] Filed: Apr. 29, 1993

[51] Int. Cl.[6] ..... G09F 1/12
[52] U.S. Cl. ..... 40/156
[58] Field of Search ..... 40/152.1, 155, 156, 40/158.1; 24/662, 324

[56] References Cited

U.S. PATENT DOCUMENTS

| | | | |
|---|---|---|---|
| 3,665,629 | 5/1972 | Shore | 40/156 |
| 4,689,906 | 9/1987 | Sherman | 40/152.1 |
| 4,790,089 | 12/1988 | Astolfi | 40/156 |
| 4,805,325 | 2/1989 | Cassard | 40/156 X |

FOREIGN PATENT DOCUMENTS

| | | | |
|---|---|---|---|
| 3635915 | 4/1988 | Germany | 40/152.1 |

*Primary Examiner*—Edward K. Look
*Assistant Examiner*—Hoang Nguyen
*Attorney, Agent, or Firm*—Salter & Michaelson

[57] ABSTRACT

A turn button for a picture frame includes an elongated body portion having first and second raised bosses on a first side surface thereof adjacent opposite ends of the body portion. The first boss has a central aperture therethrough for rotatably mounting the turn button on a picture frame, and it has a flat end face for rotatably engaging the picture frame. The second boss has a smooth rounded configuration for engaging the back surface of the picture frame without causing damage thereto. The turn button also has a third raised boss on the opposite second side surface thereof for more easily manipulating the turn button on a picture frame.

7 Claims, 1 Drawing Sheet

TURN BUTTON

BACKGROUND AND SUMMARY OF THE INVENTION

The instant invention relates to hardware for picture frames and more particularly to a turn button for releasably retaining the back of a picture frame, or a portion of the back thereof with respect to the remainder of the picture frame.

Turn buttons comprising pivotally mounted sheet metal retaining arms are widely used for releasably retaining various components of picture frames in position during use. However, the main applications for turn buttons are generally for either retaining the backs of picture frames in position relative to the respective frame portions thereof or for retaining the door back portions of picture frame backs in position relative to the remaining portions of the respective backs thereof. In this regard, when a turn button is utilized in connection with a picture frame which includes a back comprising a single, continuous, uninterrupted panel made from a sheet material, such as cardboard, it is normally secured to the rear side of the peripheral frame portion of the picture frame so that the turn button is pivotable inwardly for retaining the picture frame back in position during use. On the other hand, when a turn button is utilized in connection with a picture frame which includes a back comprising a peripheral portion and an integrally formed rearwardly pivotable door back portion which is adapted to provide access to the interior of the picture frame, the turn button is normally pivotally secured to the peripheral portion of the back so that it can be utilized for retaining the door back portion in position during use.

The most common type of heretofore available turn button comprises an elongated generally oval-shaped planar member which is blanked from a sheet metal and which has an aperture formed adjacent one end thereof. However, it has been found that turn buttons of this general type have several disadvantages. First, it has been found that because turn buttons of this type are generally blanked from sheet metals they often have relatively sharp edges which can scratch or mar the backs of picture frames as the turn buttons are pivoted. This is particularly true when turn buttons of this type are used on picture frame backs which include rearwardly facing felt laminates or the like. Second, because turn buttons of this type are generally substantially planar in configuration, they can be difficult for users to manipulate for pivoting them between operative and inoperative positions thereof. Even still further, because of the substantially planar generally symmetrical configurations of most heretofore available turn buttons, it has not been possible to manipulate them with vibratory feeder assemblies to enable them to be assembled in automated assembly operations.

The instant invention provides a turn button for a picture frame which represents a significant improvement over the heretofore available turn buttons. In particular, the instant invention provides a turn button which can be easily pivoted between operative and inoperative positions on the back of a picture frame without scoring or marring portions of the picture frame. Still more specifically, the turn button of the instant invention comprises an elongated metal body portion having opposite first and second side surfaces and opposite first and second ends, and first and second raised bosses on the first side surface adjacent the first and second ends, respectively. The first boss has an aperture therethrough and it is preferably formed so that it includes a substantially flat face portion. The second boss is preferably formed in a smooth, rounded configuration. The first and second bosses are preferably both raised by approximately the same amount relative to the first side surface of the body portion. Further the turn button preferably includes a third raised boss on the second side surface of the body portion between the first and second bosses.

Accordingly, for use and operation of the turn button of the instant invention the turn button is pivotally secured to the rear side of the frame portion of a picture frame or to the peripheral portion of a picture frame back utilize a fasting element, such as a screw or a rivet, which extends through the aperture in the first raised boss. The turn button is assembled so that the first and second raised bosses face the adjacent rearwardly facing portions of the picture frame, and accordingly as the turn button is pivoted, the face portion of the first boss is rotated on the adjacent rearwardly facing surface of the picture frame. Further, the only other portion of the turn button which actually contacts the picture frame is the rounded second boss which, because of its rounded configuration, is not likely to scratch or cause damage to the back of the picture frame as the turn button is pivoted. Further, because the turn button includes a third raised boss on the second side thereof, the turn button can be more easily manipulated by a user by grasping or pushing the third raised boss on the second side of the turn button in order to pivot the latter between the operative and inoperative positions thereof. Even still further, because the turn button is formed in an irregular configuration, which includes the first, second and third raised bosses, it is possible to position the turn button in a predetermined orientation utilizing a vibratory feeder. Hence, the turn button can be effectively assembled on a picture frame utilizing an automated assembly machine.

Accordingly, it is a primary object of the instant invention to provide an improved turn button for a picture frame.

Another object of the instant invention is to provide a turn button which is adapted to be secured to a picture frame and which is pivotable relative to the picture frame without causing damage to the back thereof.

An even still further object of the instant invention is to provide an effective turn button which can be oriented in a vibratory feeder for assembling the turn button utilizing an automated assembly apparatus.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
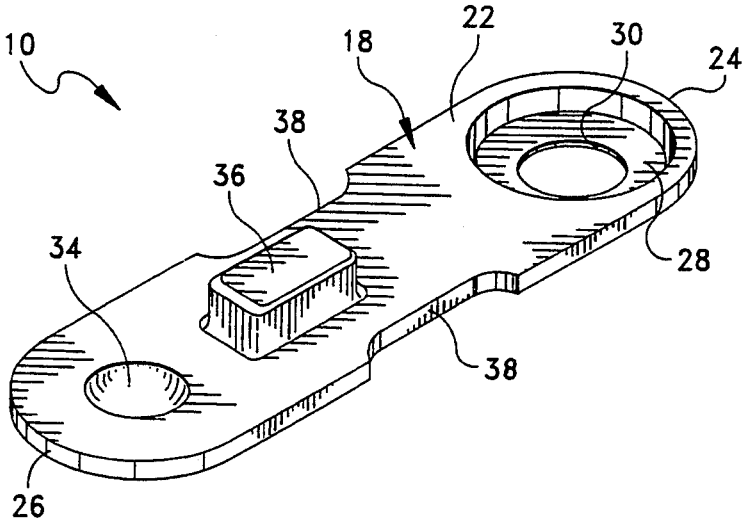
FIG. 1 is an enlarged perspective view of the turn button of the instant invention.
Figure 2:
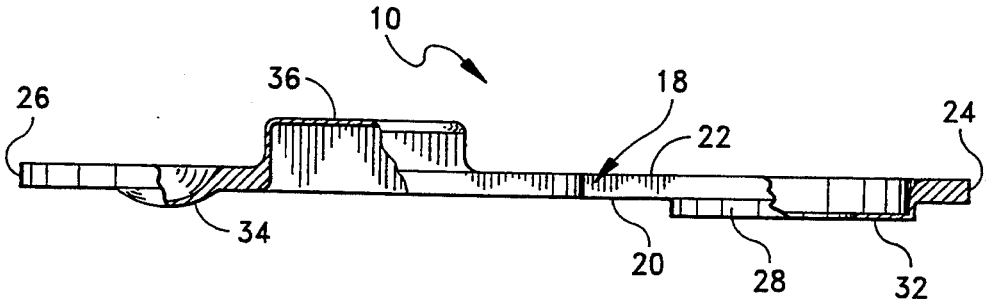
FIG. 2 is a side elevational view thereof shown in partial section.
Figure 3:
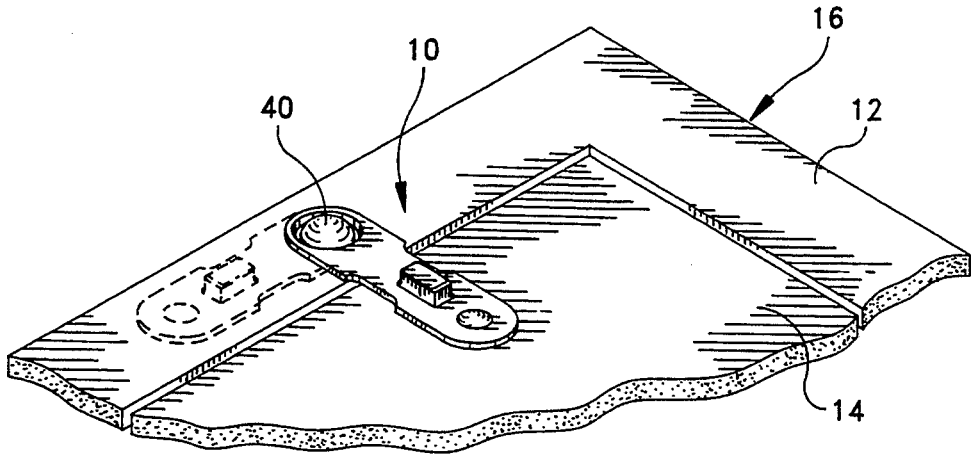
FIG. 3 is a perspective view of the turn button assembled on the back of a picture frame.

Referring now to the drawing, the turn button of the instant invention is illustrated in FIGS. 1 through 3 and generally indicated at 10. As illustrated in FIG. 3, the turn button 10 is adapted to be secured to a first portion 12 of a picture frame to enable the turn button 10 to be utilized for retaining a second portion 14 of the picture frame in a predetermined orientation relative to the first portion 12. In this regard, as illustrated in FIG. 3, the first portion 12 is embodied as the peripheral portion of a picture frame back which is generally indicated at 16 and the second portion 14 is embodied as an integrally formed central door back portion of the picture frame back 16. It will be understood, however, that the turn button 10 can alternatively be utilized in a variety of other applications, such as those wherein the latter is secured to the rear side of the frame portion of a picture frame so that the turn button 10 is pivotable for retaining the entire back portion of the picture frame in a similar manner.

The turn button 10 is preferably integrally blanked from a suitable sheet metal, such as sheet steel, and it includes a main body portion generally indicated at 18 having first and second side surfaces 20 and 22, respectively, and first and second ends 24 and 26, respectively. Integrally formed in the body portion 18 adjacent the first end 24 thereof is a first raised boss 28 which extends outwardly from the first side surface 20. The first raised boss 28 has a centrally disposed substantially circular aperture 30 therethrough, and it further includes a substantially flat end face 32. Also formed in the body portion 18 is a second raised boss 34 which extends outwardly from the first side surface 20. The second raised boss 34 is positioned adjacent the second end 26, and it is formed in a substantially smooth, rounded configuration. Further, the second raised boss 34 is raised from the first side surface 20 by substantially the same amount as the first raised boss 28. The turn button 10 further includes a third raised boss 36 which is formed in a substantially rectangular configuration between the bosses 28 and 34. The third raised boss 36, however, extends upwardly from the second side surface 22 as illustrated. The turn button 10 is further formed with a pair of cut out areas 38 which extend along opposite side edges of the central portion of the turn button 10 as illustrated in FIGS. 1 and 3.

In order to assemble the turn button 10 on the picture frame back 16 it is positioned so that the first side surface 20 of the turn button 10 faces the rear surface of the picture frame back 16. A fastening element 40, such as a screw, a nail, or a rivet, is then passed through the aperture 30 and into the first portion 12 of the picture frame back 16 in order to pivotally secure the turn button 10 thereto. The turn button 10 can then be pivoted between the operative position illustrated in FIG. 3 and the inoperative position illustrated in broken lines in FIG. 3. In this regard, as the turn button 10 is pivoted, the end face 32 is rotated on the first portion 12 of the picture frame back 16 so that end face 32 provides a solid rotatable mounting surface for the turn button 10. Further, because of the smooth rounded configuration of the boss 34 the turn button 10 will not normally scratch or mar either the first portion 12 or the second portion 14 as it is pivoted between the operative and inoperative positions thereof. Still further, because the turn button 10 includes the third raised boss 36 which extends upwardly from the second side surface 22 thereof, it can be effectively and easily manipulated by a user for pivoting the turn button between the operative and inoperative positions thereof. Even still further, because of the irregular configuration of the turn button 10 and the bosses 28, 34 and 36 it is possible to orient the turn button 10 in a vibratory feeder assembly so that it can be assembled with a picture frame utilizing an automated assembly apparatus.

It is seen therefore that the instant invention provides an effective turn button for a picture frame. The turn button 10 is adapted to be assembled on a picture frame in an automated assembly apparatus. Further, the turn button 10 is adapted to be readily and easily manipulated by a user without causing damage to portions of a picture frame on which it is mounted. Hence, it is seen that the turn button 10 represents a significant improvement in the art relating to hardware for picture frames and like.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A turn button for a picture frame comprising an elongated metal body portion having opposite first and second side surfaces and opposite first and second ends, first and second raised bosses on said first side surface adjacent said first and second ends, respectively, said first boss having an aperture therethrough for rotatably securing said turn button to a first portion of a picture frame, said second boss having a substantially smooth outwardly facing surface on said first side of said body portion for engaging a second portion at said picture frame in order to retain said second portion in a predetermined position relative to said first portion, and a third raised boss on the second side surface of said body portion between said first and second bosses for rotating said turn button relative to said first frame portion.

2. In the turn button of claim 1, said first and second raised bosses both being raised by approximately the same amount relative to said first side surface of said body portion.

3. In the turn button of claim 1, said second raised boss being formed in a smooth rounded configuration.

4. In the turn button of claim 2, said second raised boss being formed in a smooth rounded configuration.

5. In the turn button of claim 1, said first raised boss having a substantially flat end face, said aperture passing through said end face.

6. In the turn button of claim 4, said first raised boss having a substantially flat end face, said aperture passing through said end face.

7. In the turn button of claim 6, said main portion and said first, second and third bosses being integrally struck from a sheet metal.

* * * * *